US005362060A

United States Patent [19]

Hinson

[11] Patent Number: 5,362,060

[45] Date of Patent: Nov. 8, 1994

[54] STANCE MINDER FOR GOLFERS

[76] Inventor: Larry W. Hinson, Rte. 4 Box 397, Douglas, Ga. 31533

[21] Appl. No.: 99,137

[22] Filed: Jul. 29, 1993

[51] Int. Cl.[5] ..... A63B 69/36

[52] U.S. Cl. ..... 273/187 R; 273/188 A

[58] Field of Search ..... 273/187 R, 187 A, 187 B, 273/187.2, 188 R, 188 A

[56] References Cited

U.S. PATENT DOCUMENTS

| | | | |
|---|---|---|---|
| 2,025,519 | 12/1935 | Lingg | 33/174 |
| 3,041,075 | 6/1962 | Taylor | 273/187 R |
| 3,253,830 | 5/1966 | Laskin | 273/187 |
| 3,459,429 | 8/1069 | Green | 273/187 |
| 3,638,950 | 2/1972 | Hyotlaine | 273/187 R |
| 4,257,608 | 3/1981 | Funk | 273/187 R |
| 4,538,815 | 9/1985 | Poirier | 273/187 R |

*Primary Examiner*—George J. Marlo

*Attorney, Agent, or Firm*—Jacobson, Price, Holman & Stern

[57] ABSTRACT

A stance minder for use by golfers to enable golfers to correctly position themselves in relation to a golf ball which enables a golfer to maintain an optimal swing pattern for the golf club. The stance minder includes an elongated slotted base member or line corrector having a pointed end and an elongated longitudinal slot which is positioned on a golf course surface with the pointed end in the direction of a desired target area of the golf ball. Attached to the base member is a perpendicular member forming a position reminder that is oriented perpendicular to the base member and extends laterally therefrom in an adjustable manner due to the provision of a longitudinal slot which intersects with the slot in the base member and a clamp bolt assembly secures the base member and perpendicular member in adjusted positions. Also mounted on the base member is a pair of foot position indicators or correctors each including a concave side and being substantially alike in construction which extend laterally from the base member opposite to the perpendicular member for indicating the correct positioning of the feet of a golfer with the left foot position indicator of a right handed golfer being longitudinally adjustable on the base member by a clamp bolt extending through the slot in the base member with the perpendicular member oriented generally between the foot position indicators. For a right handed golfer, the concave side of the left foot indicator is positioned along and generally conforms to the curvature of the inner side of the golfer's left foot, while the concave side of the right foot indicator is positioned along and generally conforms to the curvature of the outer side of the golfer's right foot.

6 Claims, 1 Drawing Sheet

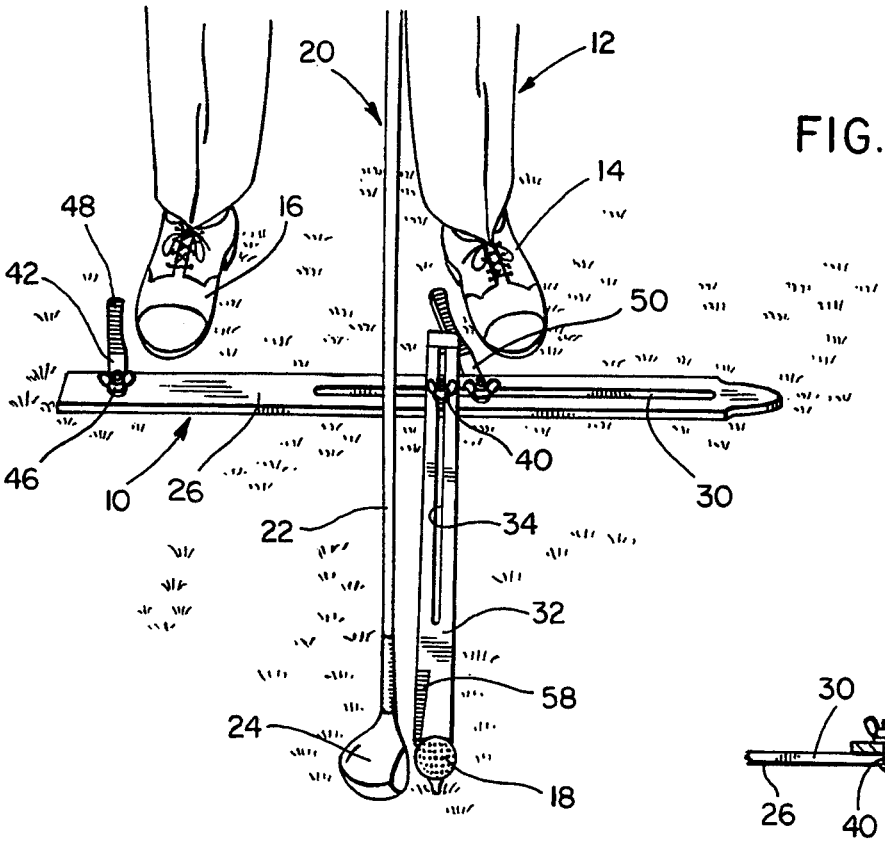
FIG. 1
FIG. 3
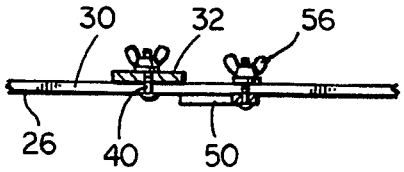
FIG. 2
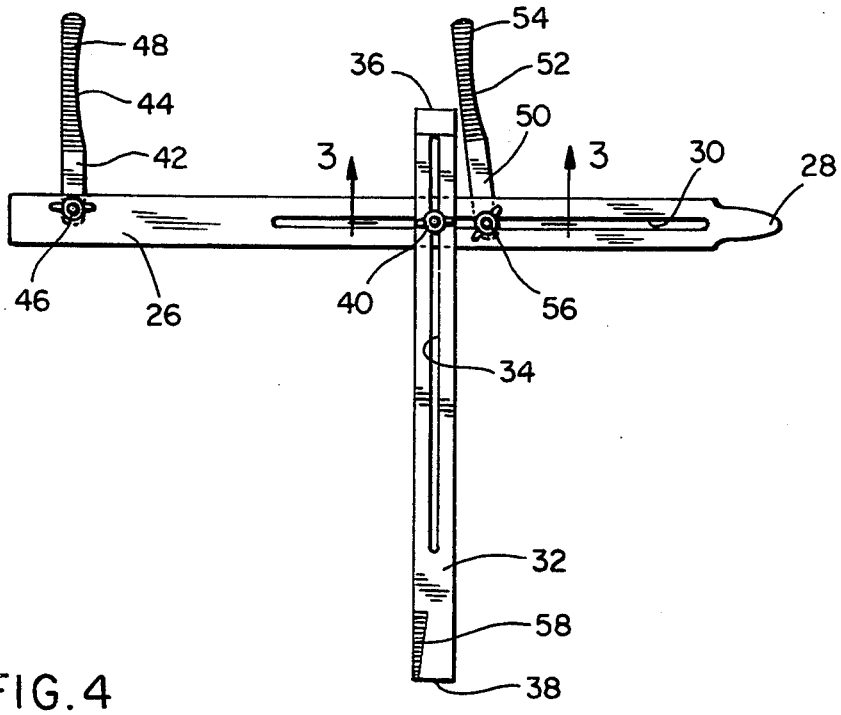
FIG. 4
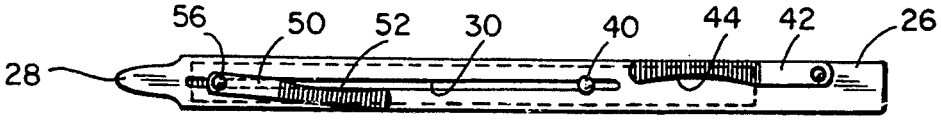

STANCE MINDER FOR GOLFERS

BACKGROUND OF THE INVENTION

1. Field of the Invention

The present invention generally relates to a stance minder for use by golfers to enable golfers to correctly position themselves in relation to a golf ball which enables a golfer to maintain an optimal swing pattern for the golf club. The stance minder includes an elongated slotted base member or line corrector having a pointed end and an elongated longitudinal slot which is positioned on a golf course surface with the pointed end in the direction of a desired target area of the golf ball. Attached to the base member is a perpendicular member forming a position reminder that is oriented perpendicular to the base member and extends laterally therefrom in an adjustable manner due to the provision of a longitudinal slot which intersects with the slot in the base member and a clamp bolt assembly secures the base member and perpendicular member in adjusted positions. Also mounted on the base member is a pair of foot position indicators or correctors which extend laterally from the base member opposite to the perpendicular member for indicating the correct positioning of the feet of a golfer with the left foot position indicator of a right handed golfer being longitudinally adjustable on the base member by a clamp bolt extending through the slot in the base member with the perpendicular member oriented generally between the foot position indicators. The perpendicular member has a width substantially equal to the diameter of a golf ball and is provided with an angle marking adjacent the ball to enable the golfer to easily check the forward press of the club. The stance minder may be easily folded or collapsed into a straight line condition for ease of storage and transport in the golf bag if desired.

2. Description of the Prior Art

Many devices have been provided with the aim of improving the ability of golfers to correctly position themselves in relation to a golf ball and swing the club in an optimum pattern or cycle to effectively project the ball in a desired path of trajectory toward a target area on the fairway or the hole pin or cup on the green. Many golfers utilize the services of skilled instructors to assist them in improving various characteristics of their golf game. However, it frequently occurs that when assistance is needed, an instructor is not available. Thus, many devices have been developed which can be used by the golfer in an effort to maintain optimum swing characteristics or correct any discernable fault in the swing characteristics in the interest of obtaining an ideal golf stroke. The following U.S. patents relate to developments in this field of endeavor.

U.S. Pat. No. 2,025,519
U.S. Pat. No. 3,253,830
U.S. Pat. No. 3,459,429
U.S. Pat. No. 3,638,950
U.S. Pat. No. 4,257,608
U.S. Pat. No. 4,538,815

The above mentioned patents disclose various devices for use by golfers but do not solve the problems that causes golfers to use less than an optimum swing pattern. U.S. Pat. No. 3,638,950 discloses slotted strips oriented in perpendicular, adjustable relation but this type of structure does not deal with or provide any solution to the problem of swaying of a golfer when swinging the club. While it may seem that swaying by the golfer creates more power, it also provides for more moving parts of the anatomy of the golfer such as movement of the head being incorporated into the swing which can trigger other problems and the vertical rod in the above mentioned patent introduces problems relating to movement of the left knee which must turn in to allow the transfer of the weight of the golfer on the take away of the swing to the inside of the right foot of a right handed golfer. Thus, while the previously known devices as illustrated in the above listed patents endeavor to improve a golf swing, the physical structure and relationship of components of the prior art devices do not appear to adequately solve certain well known problems which exists in the golf swing of individual golfers.

SUMMARY OF THE INVENTION

An object of the invention is to provide a stance minder for golfers to enable a golfer to receive position instructions from the stance minder without the presence or help of an instructor with the stance minder including a plurality of elongated, relatively narrow components which can be extended and positioned for use or collapsed and folded into a compact condition for storage and transport in a golf bag or the like.

Another object of the invention is to provide a stance minder for golfers to enable a golfer to assume a correct position with respect to a golf ball in order that an optimum swing pattern may be obtained and practiced with respect to different clubs and situations which may be encountered in which the stance minder may be left in place while actually hitting the golf ball with the stance minder providing no interference with the golf swing pattern.

A further object of the invention is to provide a stance minder from which a golfer will receive instructions for correct foot alignment which will help the golfer to maintain proper balance while detecting swaying using the foot corrector or position indicator, obtain ball positioning alignment relative to the stance and target, provide precise arm/club length distance, check club face position using back side of perpendicular member, obtain simple set up of all clubs because of the continuous slot on the base member, easily check forward press of the club using angle markings at the end of the perpendicular member, check head position throughout the swing using the perpendicular member as a guide, maintain correct posture when striking the ball, use the stance minder without disturbing the stance minder throughout the entire swing and enable the device to be collapsed to form a structure no longer and wider than the base member to provide for ease of portability in the golf bag.

These together with other objects and advantages which will become subsequently apparent reside in the details of constructions and operation as more fully hereinafter described and claimed, reference being had to the accompanying drawings forming a part hereof, wherein like numerals refer to like parts throughout

BRIEF DESCRIPTION OF THE DRAWINGS

FIG. 1 is a perspective view of the stance minder of the present invention illustrating the association of the golf club shaft and head and the feet of the golfer in relation to the stance minder.

FIG. 2 is a top plan view of the stance minder.

FIG. 3 is a detailed sectional view taken along section line 3—3 on FIG. 2 illustrating structural details of the components.

FIG. 4 is a bottom plan view illustrating the stance minder in collapsed or folded condition.

DESCRIPTION OF THE PREFERRED EMBODIMENT

Referring specifically to the drawings, the stance minder forming the present invention is generally designated by reference numeral 10 and is used by a golfer generally designated by reference numeral 12 for indicating the position of the left foot 14 and right foot 16 of a right handed golfer in relation to a golf ball 18 and in relation to a golf club generally designated by reference numeral 20 including the club shaft 22 and club head 24 which, in the illustration is a wood club thereby enabling a golfer to assume a correct position in relation to the golf ball 18 on a tee or resting on the golf course surface depending upon what type of golf club 20 is being used and depending upon the condition encountered in various situations in which the golf ball is to be engaged by a club head in order for the club and club head to be swung in an optimum swing pattern.

The stance minder includes an elongated, relatively narrow base member 26 or line corrector which is provided with a pointed end 28 oriented in the direction of a target for the golf ball 18. The elongated, narrow base member 26 is provided with an elongated closed end slot 30 therein which extends from a point adjacent the pointed end 28 with the other end of the slot being spaced from the opposite end of the base member 26.

Mounted in perpendicular relation to the base member 26 is a perpendicular member 32 in the form of a narrow strip which serves as a position reminder with the perpendicular member including an elongated slot 34 which terminates adjacent one straight transverse end edge 36 and terminates in spaced relation to the other transverse straight end edge 38 which is positioned adjacent the golf ball 18 with the end edge 36 of the perpendicular member 32 being located on the opposite side of the base member 26 from the ball 18 as illustrated in FIGS. 1 and 2.

The perpendicular member 32 is adjustable secured in perpendicular overlying relation to the base member 26 by the overlying and intersecting slots 30 and 34 with a clamp bolt and wing nut assembly 40 extending through the aligned and intersecting slots to enable the perpendicular member 32 to move laterally in relation to the base member 26 for proper spaced relation between the golf ball 18 and the base member 26 and the position of the ball 18 in relation to the feet 14 and 16 by longitudinal adjustment of the perpendicular member 32 depending upon the type of club to be used and the target area for the golf ball 18. The construction of the perpendicular member 32 and the base member 36 and the bolt and wing nut assembly 40 enables the perpendicular member 32 to be pivoted to a position in overlying relation to the base member 26.

The end of the base member 26 remote from the pointed end 28 is provided with a right foot position indicator or foot corrector 42 in the form of a narrow strip having a concave curved edge 44 facing the outer edge portion of the right foot 16 as illustrated in FIG. 1. The right foot position indicator 42 is pivotally attached to the base member 26 adjacent the end thereof remote from the pointed end by a bolt and wing nut assembly 46 which enables the position indicator 42 to be pivoted into underlying relation to the base member 26 as illustrated. Also, the upper surface of the position indicator 42 may be colored a readily distinguishable color as at 48 to enable the golfer to more easily observe the relationship of the position indicator to the right foot of a right handed golfer.

Pivotally and longitudinally adjustably connected to the base member 26 between the perpendicular member 32 and the pointed end 28 is a left foot position indicator or corrector 50 which is substantially the same in construction as the position indicator 42 with one edge of the position indicator 50 including a concave curved edge 52 for indicating the position of the left foot 14 of the golfer. The upper surface of at least a portion of the left foot position indicator is distinguishably colored as at 54 in the same manner as the right foot position indicator. The left foot position indicator 50 is connected to the base member 26 by a bolt and wing nut assembly 56 which extends through the slot 30 which enables the left foot position indicator to be adjusted longitudinally along the length of the base member for varying the position of the left foot 14 of a right handed golfer.

The upper surface of the perpendicular member 32 includes a ten degree angle marking 58 extending inwardly from an outer corner of the perpendicular member 32 where it intersects with the end edge 38 as illustrated in FIG. 2 to enable the golfer to easily check the forward press of the golf club head 24 in order that the club can be squared up. Also, the width of the perpendicular member 32 being substantially the same as the diameter of a golf ball enables the perpendicular member to serve as a square end edge or surface in order to provide the golfer the opportunity to square the club face as the base member points toward the desired target. The device is quite simple to use and can be easily folded or collapsed into a compact condition. While the device is simple, it is fundamentally sound for the golf swing and it can adjust for slightly open or closed stance arrangements depending upon the desire of the individual golfer. This device helps a golfer to have a comfortable and repetitive swing. The stance minder enables the golfer to hit the ball while the golfer is set up in the stance minder and it is not necessary to move the stance minder out of the way for any golf shot which allows the golfer to continue with a train of thought or a swing pattern without constant interruptions to reset the device. The physical structure and makeup of the stance minder assists in solving the problem of swaying which sometimes may appear to create more power but also allows moving parts such as the head which can trigger other problems. A proper golf swing requires the proper turn to create the coil to generate club speed and at the same time staying on the ball with your head and body in a central position. The weight of the golfer is transferred on the takeaway of the swing to the inside of the right foot of a right handed golfer and vice versa for a left. The left knee must turn in to allow the transfer. The stance minder provides a simple sway indicator using the right foot corrector or position indicator 42 for a right handed golfer. If the weight were transferred to the outside of the right foot instead of keeping it on the inside, the right foot would simple touch the right foot position indicator causing the foot position indicator to move thereby notifying the golfer that he or she has swayed. The stance minder foot positioner or corrector used to detect swaying remains intact and can easily be pivoted along with the other parts of the device to easily fit into any golf bag.

The drawings illustrate an arrangement in which adjustment enables use of the stance minder with various clubs in view of the required relationship between different club heads and the golf ball and different stance requirements for different clubs. It is also within the purview of this invention to provide an arrangement where the stance minder is provided for use with only a single club such as a wood or driver. In that event, the perpendicular member 32 may be merely pivoted to the base member and moved to a perpendicular arrangement about a fixed axis by the use of crimped or spring loaded detents cooperating between the perpendicular member and the base member to permit perpendicular member 32 to pivot to an overlying position on the base member 26 and snap into perpendicular relation thereby enabling the stance minder to be used without any clamp bolts with the fixed relationship of the components after pivoting to operative position providing proper guidance to a golfer in the use of one particular club.

The dimensional characteristics may vary but it has been found that sturdy wood components may be used or, if desired, lightweight metal components may be used. The base member 26 may have an overall length of 36 inches with a width of 2 ½ inches and a slot width of ¼ inch with the slot extending from approximately 3 inches from the pointed end to a point approximately 10 inches from the opposite end. The perpendicular member 32 may have a length of 28 inches and width of 1 ⅝ inches with the slot commencing approximately 5 inches from the end thereof to be disposed adjacent the golf ball and approximately ½ inch from the opposite end. Each of the foot position indicators may be approximately 10 inches long and 1 inch in width with the concave edge surface extending for approximately 6 inches. As indicated, the particular materials from the which the device is constructed and the specific dimensional characteristics may vary. The stance minder provides a simple, lightweight but yet easily set up and effectively used device for assisting a golfer in obtaining a correct swing pattern for striking a golf ball.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A stance minder for golfers comprising an elongated, straight, rigid base member adapted to be positioned on the surface of a golf course along a desired line of flight of a golf ball and in adjacent relation to toe areas of a golfer's feet which are oriented generally laterally of the base member, said base member having a length greater than the distance between the golfer's feet and extending beyond the golfer's feet, said base member having an end termination generally in a point adapted to be positioned in spaced relation to the left foot of a right handed golfer and aimed along a desired flight path of a golf ball toward a target area, an elongated, straight, rigid position reminder member mounted on said base member in perpendicular relation thereto and extending laterally therefrom intermediate the ends of the base member, said position reminder member having an end portion remote from the base member for positioning adjacent a golf ball to be struck by a selected golf club and a pair of elongated foot position indicators each including a concave side mounted on said base member, said foot position indicators being substantially alike in construction and extending laterally therefrom in opposite lateral direction to the position reminder member to indicate the position of the feet of a golfer with respect to the base member, position reminder member and golf ball at the end of the position reminder member, said base member, position reminder member and foot position indicators being configured and dimensioned to enable a golf club head to move in a path to strike a golf ball positioned at the end portion of the position reminder member during an optimum swing pattern of the golf club by a golfer, each of said foot indicators adapted to extend a substantial distance along side the feet with the concave side of the foot indicator along side the left foot of a right handed golfer being positioned along and generally conforming to the curvature of the inner side of the left foot and the concave side of the foot indicator positioned along side the right foot of a right handed golfer being positioned along and generally conforming to the curvature of the outer side of the right foot, and means interconnecting the base member and position reminder member to enable adjustment of the position reminder member longitudinally along the base member and to vary the relation of the position reminder member to the foot position indicators.

2. The stance minder as defined in claim 1 wherein said base member and position reminder member are in the form of narrow strips, means pivotally interconnecting the base member and position reminder member to enable the position reminder member to be pivoted to a position alongside the base member to enable the stance minder to be folded into a compact condition for ease of transport and storage in a golf bag, each foot position indicator being pivotally attached to said base member to enable the foot position indicators to be pivoted into alignment with the base member for enabling the stance minder to be folded into compact condition.

3. The stance minder as defined in claim 2 wherein said means interconnecting the base member and position reminder member includes a longitudinal slot extending over a major portion of the length thereof and a longitudinal slot extending over a major portion of the length of the position reminder member with the pivotal connection between the base member and position reminder member being in the form of a clamp bolt assembly to enable longitudinal adjustment of the position reminder member in relation to the base member and longitudinal movement of the position reminder member laterally of the base member to vary the spatial relation between the base member and the end of the position reminder member and the golf ball positioned at the end of the position reminder member thereby enabling the stance minder to be used when a golfer is using golf clubs having different overall length characteristics.

4. The stance minder as defined in claim 1 wherein each of said foot position indicators is in the form of a narrow strip of rigid material with each strip including an edge adapted to be adjacent the foot of a golfer for providing a guide for positioning the feet of a golfer alongside the position indicator.

5. The stance minder as defined in claim 1 wherein said base member and foot position indicator associated with the left foot of a right handed golfer includes a means to enable longitudinal adjustment thereof along the base member and adjustment in relation to the position reminder member to enable adjustment of the stance of a golfer to enable a golfer to use any golf club with the stance minder.

6. The stance minder as defined in claim 1 wherein the end of said position reminder member remote from said base member includes an angled indicator area to indicate the angle of the forward press of the hands of a golfer when the golfer addresses the golf ball.

* * * * *